US009589510B2

(12) United States Patent
Lee et al.

(10) Patent No.: US 9,589,510 B2
(45) Date of Patent: Mar. 7, 2017

(54) POWER SUPPLY DEVICE AND ORGANIC LIGHT EMITTING DISPLAY APPARATUS INCLUDING THE SAME

(71) Applicant: Samsung Display Co., Ltd., Yongin (KR)

(72) Inventors: Jaehoon Lee, Yongin (KR); Jinwoo Kim, Yongin (KR); Byunghyuk Shin, Yongin (KR); Byeongdoo Kang, Yongin (KR); Dohyung Ryu, Yongin (KR); Jaewoo Song, Yongin (KR); Haegoo Jung, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 85 days.

(21) Appl. No.: 14/583,992

(22) Filed: Dec. 29, 2014

(65) Prior Publication Data

US 2016/0049111 A1 Feb. 18, 2016

(30) Foreign Application Priority Data

Aug. 12, 2014 (KR) ..... 10-2014-0104529

(51) Int. Cl.
*G09G 3/32* (2016.01)
*G09G 3/20* (2006.01)

(52) U.S. Cl.
CPC ..... *G09G 3/3291* (2013.01); *G09G 3/2022* (2013.01); *G09G 3/3258* (2013.01); *G09G 2310/027* (2013.01); *G09G 2310/0289* (2013.01); *G09G 2310/0291* (2013.01); *G09G 2320/0233* (2013.01); *G09G 2320/064* (2013.01); *G09G 2330/00* (2013.01); *G09G 2330/021* (2013.01); *G09G 2330/028* (2013.01)

(58) Field of Classification Search
CPC .. G09G 3/2014; G09G 3/3266; G09G 3/3291; G09G 3/3696; G09G 2310/027; G09G 2310/0289; G09G 2310/0291; G09G 2320/0233; G09G 2320/064; G09G 2330/00; G09G 2330/026; G09G 2330/028; G09G 3/0222; G09G 3/3258
USPC ..... 345/691
See application file for complete search history.

(56) References Cited

U.S. PATENT DOCUMENTS 6,191,504 B1 * 2/2001 Kawata ..... G06F 1/3218 307/116
6,204,610 B1 3/2001 Komiya
8,289,305 B2 * 10/2012 Kang ..... H05B 33/0848 315/219
2002/0101395 A1 8/2002 Inukai
(Continued)

FOREIGN PATENT DOCUMENTS

JP 2000-267628 9/2000
KR 2002-0063527 8/2002
KR 2002-0069488 9/2002

*Primary Examiner* — Tom Sheng
(74) *Attorney, Agent, or Firm* — H.C. Park & Associates, PLC

(57) ABSTRACT

A power supply device includes: a feedback controller configured to detect a feedback voltage based on an output voltage of a power output line connected to a power input line to which a power supply voltage is supplied; a voltage controller configured to detect a level change of the power supply voltage based on the feedback voltage; and a voltage generator configured to adjust the power supply voltage according to the detected level change.

20 Claims, 13 Drawing Sheets

(56) References Cited

U.S. PATENT DOCUMENTS

| | | | | |
|---|---|---|---|---|
| 2002/0175635 | A1 | 11/2002 | Komiya | |
| 2013/0106676 | A1* | 5/2013 | Ono | G09G 3/3233 345/76 |
| 2013/0229402 | A1* | 9/2013 | Park | G09G 3/32 345/212 |
| 2013/0241808 | A1* | 9/2013 | Kwon | H02M 3/158 345/76 |
| 2014/0139132 | A1* | 5/2014 | Kwak | G09G 3/006 315/224 |
| 2015/0243212 | A1 | 8/2015 | Lee et al. | |
| 2015/0294612 | A1* | 10/2015 | Kim | G09G 3/3225 345/690 |

* cited by examiner

POWER SUPPLY DEVICE AND ORGANIC LIGHT EMITTING DISPLAY APPARATUS INCLUDING THE SAME

CROSS REFERENCE TO RELATED APPLICATION

This application claims priority from and the benefit of Korean Patent Application No. 10-2014-0104529, filed on Aug. 12, 2014, which is hereby incorporated by reference for all purposes as if fully set forth herein.

BACKGROUND

Field

The following disclosure relates to a power supply device and an organic light emitting display apparatus.

Discussion of the Background

An organic light emitting display apparatus displays images by using an organic light emitting diode (OLED) that emits light by using recombination of electrons and holes, and has advantages, such as fast response speed and low power consumption.

An organic light emitting display apparatus includes a plurality of scan lines, a plurality of data lines, a plurality of power lines, and a plurality of pixels connected to the above lines to be arranged as a matrix. Pixels of an organic light emitting display apparatus operating in an analog driving method provide a gray scale by adjusting brightness according to the level of input voltage or current data. Pixels of an organic light emitting display apparatus operating in a digital driving method emit light with the same brightness, but provide a gray scale by providing different light emission times.

Due to relatively large currents flowing through the power lines and resistance components of the power lines, voltage drops may occur in the power lines. Depending on positions of the pixels and/or lapse of time in one frame, power supply voltages having different voltage levels may be applied to pixels, such that the pixels may not emit light with a desired brightness due to luminance variation occurring due to the different voltage levels.

SUMMARY

Exemplary embodiments of the present invention provide one or more embodiments of the present invention include an organic light emitting display apparatus to reduce luminance variation occurring due to a voltage drop of a power supply voltage line.

Additional features of the invention will be set forth in the description which follows, and in part will be apparent from the description, or may be learned by practice of the invention.

Exemplary embodiments of the present invention provide a power supply device including a feedback controller configured to detect a feedback voltage based on an output voltage of a power output line connected to a power input line to which a power supply voltage is input; a voltage controller configured to detect a level change of the power supply voltage based on the feedback voltage; and a voltage generator configured to adjust the power supply voltage according to the detected level change.

Exemplary embodiments of the present invention provide an organic light emitting display apparatus including a display panel including a power input line to which a power supply voltage is input, and a power output line connected to the power input line; and a power supplier configured to detect a feedback voltage from an output voltage of the power output line, detect a level change of the power supply voltage based on the feedback voltage, and adjust the power supply voltage according to the detected level change.

Exemplary embodiments of the present invention provide, luminance variation of pixels may be reduced as variation of a level difference of a power supply voltage applied to pixels of an organic light emitting display apparatus is reduced. Accordingly, the quality of images that are displayed by an organic light emitting display apparatus may be improved.

It is to be understood that both the foregoing general description and the following detailed description are exemplary and explanatory and are intended to provide further explanation of the invention as claimed. Other features and aspects will be apparent from the following detailed description, the drawings, and the claims.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
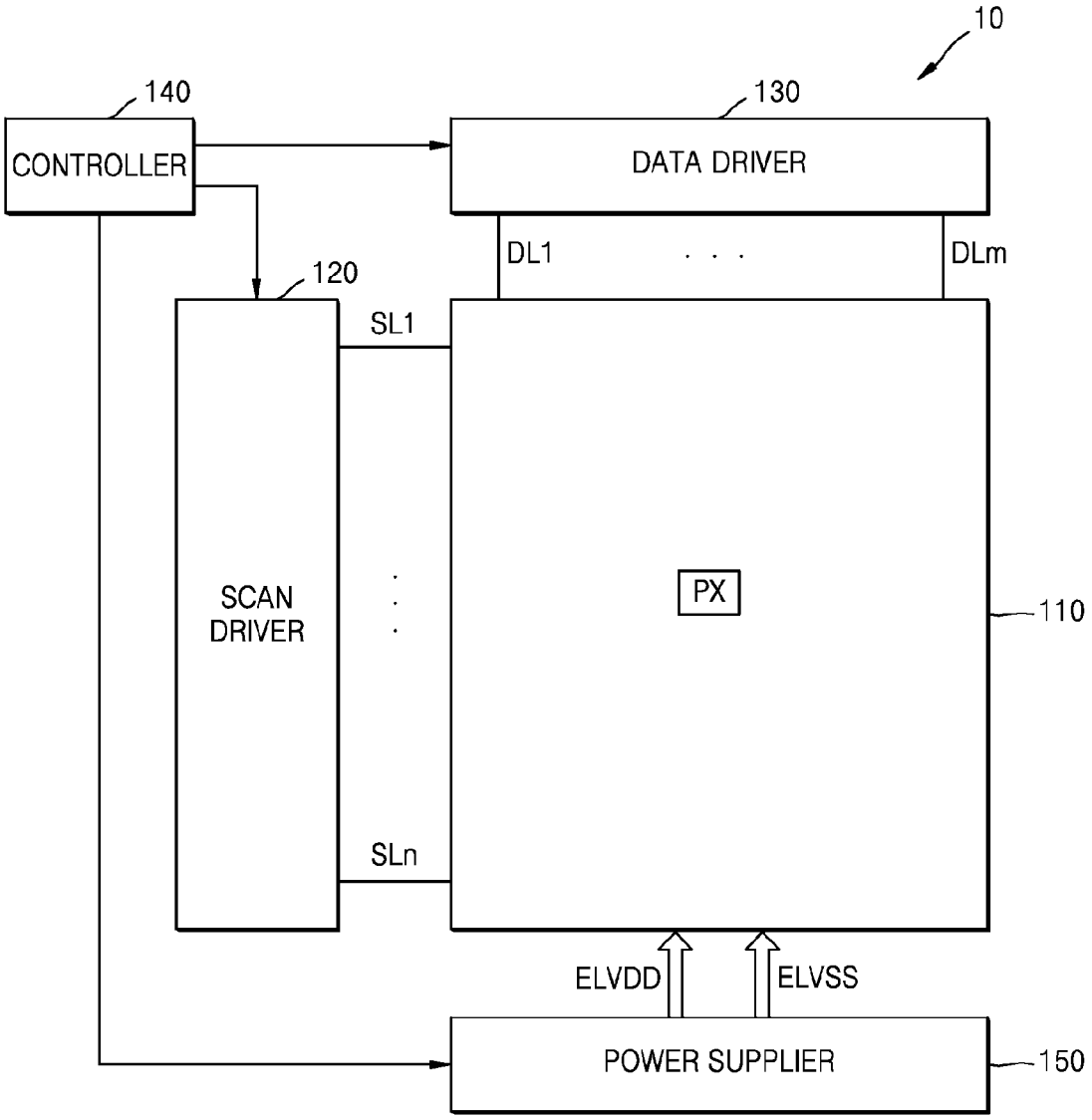
FIG. 1 is a block diagram of an organic light emitting display apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements. It will be understood that for the purposes of this disclosure, "at least one of X, Y, and Z" can be construed as X only, Y only, Z only, or any combination of two or more items X, Y, and Z (e.g., XYZ, XZ, XYY, YZ, ZZ). Throughout the drawings and the detailed description, unless otherwise described, the same drawing reference numerals are understood to refer to the same elements, features, and structures. The relative size and depiction of these elements may be exaggerated for clarity.

It will be understood that the term "and/or" includes any and all combinations of one or more of the associated listed items. Expressions such as "at least one of," when preceding a list of elements, modify the entire list of elements and do not modify the individual elements of the list. It will be understood that although the terms "first", "second", etc. may be used herein to describe various components, these components should not be limited by these terms. These components are only used to distinguish one component from another. As used herein, the singular forms "a," "an" and "the" are intended to include the plural forms as well, unless the context clearly indicates otherwise. It will be further understood that the terms "comprises" and/or "comprising" used herein specify the presence of stated features or components, but do not preclude the presence or addition of one or more other features or components.

FIG. 1 is a block diagram of an organic light emitting display apparatus 10 according to an exemplary embodiment of the present invention.

Referring to FIG. 1, the organic light emitting display apparatus 10 includes a display panel 110, a scan driver 120, a data driver 130, a controller 140, and a power supplier 150.

A plurality of pixels PX of the display panel 110 is arranged in a matrix form. Each of the plurality of pixels PX is connected to a scan line SL, a data line DL, a first power line for receiving a first power supply voltage ELVDD, and a second power line for receiving a second power supply voltage ELVSS. The first power supply voltage ELVDD and/or the second power supply voltage ELVSS may be received from the power supplier 150.

The display panel 110 includes scan lines SL1 to SLn applying scan signals to the pixels PX and data lines DL1 to DLm applying data signals to the pixels PX. Also, the display panel 110 may include a power line network for applying the first power supply voltage ELVDD and/or the second power supply voltage ELVSS to the pixels PX. Each of the scan lines SL1 to SLn may be connected to pixels PX arranged in the same row, and each of the data lines DL1 to DLm may be connected to pixels PX arranged in the same column. Each of the pixels PX may emit or not emit light according to a logic level of a data signal received through one of the data lines DL1 to DLm, which may be in response to a scan signal received through one of the scan signals SL1 to SLn. In this case, the display panel 110 may operate in a digital driving method. However, aspects of the invention are not limited thereto, such that the display panel 110 may operate in an analog driving method. When the display panel 110 operates in the analog driving method, each of the pixels PX may emit light with brightness corresponding to a voltage level or current level of a data signal received through one of the data lines DL1 to DLm, which may be in response to a scan signal received through one of the scan signals SL1 to SLn. Below, various exemplary embodiments of the present invention may be described with respect to the organic light emitting display apparatus operating in the digital driving method. However, aspects of the invention are not limited thereto, such that exemplary embodiments of the present invention may also be applied to an organic light emitting display apparatus operating in the analog driving method as well as other driving methods.

As described above, the organic light emitting display apparatus 10 may operate in the digital driving method. The controller 140 may receive image data from the outside and control at least one of the scan driver 120, the data driver 130, and the power supplier 150. The controller 140 may generate a plurality of control signals and digital data, provide at least one control signal to the scan driver 120, provide at least one control signal and the digital data to the data driver 130, and provide at least one control signal to the power supplier 150.

The scan driver 120 may drive the scan lines SL1 to SLn in a predetermined order for each unit time in one frame under the control of the controller 140. For example, a first scan line (e.g., the scan line SL1) may be driven several times in one frame by the scan driver 120. More specifically, the scan driver 120 may output a scan signal to the first scan line SL1 several times during one frame.

The data driver 130 may receive line data having m bits from the controller 140 for each unit time, and apply the line data having m bits to m data lines DL1 to DLm under the control of the controller 140 (where m is a natural number). For example, among the line data having m bits, a data signal having a logic level corresponding to a logic value of a first bit may be provided to a first data line (e.g., data line DL1). The data signal may be a digital signal having a low level or high level, and a pixel PX receiving the data signal may or may not emit light according to a logic level of the data signal.

According to aspects of the invention, a pixel PX receiving a data signal having a first logic level may emit light and a pixel PX receiving a data signal having a second logic level may not emit light. According to a circuit configuration of a pixel PX, the first logic level and the second logic level may be a low level and a high level, respectively, and vice versa. The low level may refer to a level below a reference threshold, and the high level may refer to a level above another reference threshold. The reference threshold may be the same or different.

The scan driver 120, the data driver 130, and the controller 140 may be configured as separate integrated circuit chips or as a single integrated circuit chip, which may be directly mounted on the display panel 110, be mounted on a flexible printed circuit film, be attached to the display panel 110 in a form of a tape carrier package (TCP), or be directly formed on the display panel 110.

The power supplier 150 may receive an external power supply voltage and/or an internal power supply voltage, convert the received external power supply voltage and/or internal power supply voltage into voltages having various levels for operations of components, and supply the voltages to the display panel 110 according to a power supply control signal from the controller 140. The power supplier 150 may be electrically connected to the display panel 110 through a flexible printed circuit board while being mounted on a printed circuit board.

The power supplier 150 may generate the first power supply voltage ELVDD and the second power supply voltage ELVSS under the control of the controller 140. The power supplier 150 may provide or transmit the generated first power supply voltage ELVDD and the generated second power supply voltage ELVSS to the display panel 110. The voltage level of the first power supply voltage ELVDD may be higher than that of the second power supply voltage ELVSS. For example, when the first power supply voltage ELVDD is applied to an anode of an organic light emitting device and the second power supply voltage ELVSS is applied to a cathode thereof, the organic light emitting device may emit a light.

The voltage level of the first power supply voltage ELVDD and the voltage level of the second power supply voltage ELVSS may vary according to the position of the pixel PX. More particularly, in the digital driving method, the voltage level of the first power supply voltage ELVDD and the voltage level of the second power supply voltage ELVSS may vary according to time in one frame. Accordingly, while representing a low gray scale, a defect, such as a whitish band, may occur or be seen in a central region of a screen of the display panel 110.

The power supplier 150 may reduce or minimize luminance variation of the display panel 110 by feeding back voltage level changes, which may occur according to time, of the first and second power supply voltages ELVDD and ELVSS, and then correcting the voltage levels of the first and second power supply voltages ELVDD and ELVSS. A more detailed structure and operation of the power supplier 150 will be described later.

Figure 2:
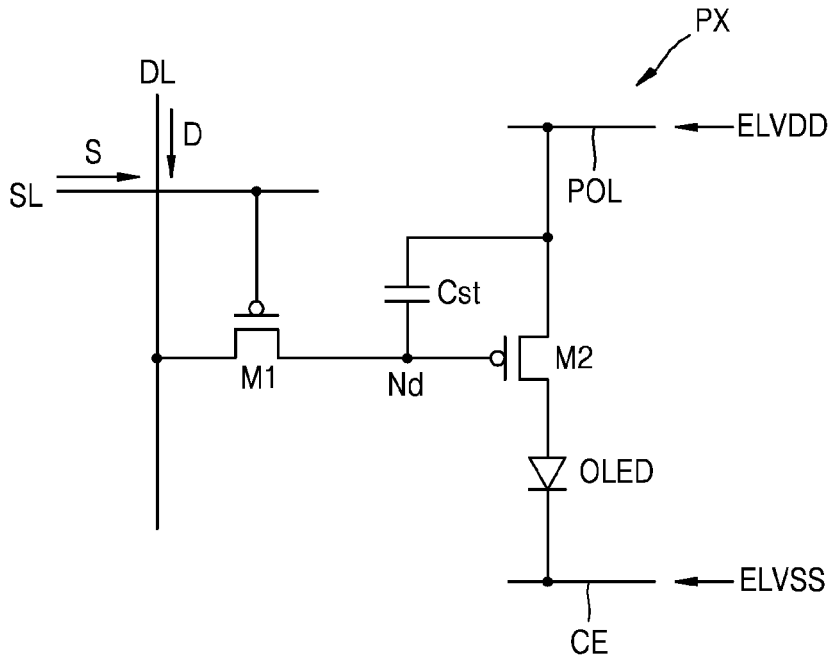
FIG. 2 is a diagram illustrating a circuit configuration of a pixel of the organic light emitting display apparatus of FIG. 1 according to an exemplary embodiment of the present invention.

FIG. 2 is a diagram illustrating a circuit configuration of a pixel PX of the organic light emitting display apparatus of FIG. 1 according to an exemplary embodiment of the present invention.

Referring to FIG. 2, the pixel PX is connected to a scan line SL and a data line DL. The pixel PX includes a pixel circuit, which includes a first transistor M1, a second transistor M2, and a storage capacitor Cst, and a light emitting device. The light emitting device may be an organic light emitting device OLED. The first and second transistors M1 and M2 may be thin film transistors. The first transistor M1 includes a first terminal connected to the data line DL, a second terminal connected to a node Nd, and a control terminal connected to the scan line SL. The second transistor M2 includes a first terminal connected to a power output line POL to which the first power supply voltage ELVDD is applied, a control terminal connected to the node Nd, and a second terminal connected to a first electrode of the organic light emitting device OLED. The storage capacitor Cst includes a first terminal connected to the first terminal of the second transistor M2 and a second terminal connected to the node Nd. The organic light emitting device OLED includes a first electrode connected to the second terminal of the second transistor M2, and a second electrode connected to a common electrode CE to which the second power supply voltage ELVSS is applied. The first electrode and second electrode of the organic light emitting device OLED may be an anode electrode and a cathode electrode, respectively.

The pixel PX receives a scan signal S through a scan line SL and receives a data signal D through a data line DL. The first transistor M1 may transfer the data signal D to the control terminal of the second transistor M2 in response to the scan signal S. The second transistor M2 may be turned on or turned off according to a logic level of the transferred data signal D. When the second transistor M2 is turned on, the first power supply voltage ELVDD may be transferred to the first electrode of the organic light emitting device OLED. The storage capacitor Cst may maintain a turn-on state or turn-off state of the second transistor M2, which may be determined according to the logic level of the data signal D, during a sub-field time period. For example, when the data signal D has a first logic level, the first power supply voltage ELVDD may be applied to the first electrode of the organic light emitting device OLED, and thus, the organic light emitting device may emit light. When the data signal D has a second logic level, the second transistor M2 may be turned off and the first power supply voltage ELVDD may not applied to the first electrode of the organic light emitting device OLED, and thus, the organic light emitting device OLED does not emit light.

The circuit configuration of the pixel PX illustrated in FIG. 2 is only an example, and aspects of the invention are not limited thereto, such that the pixel PX may have other circuit configurations.

The organic light emitting display apparatus 10 operating in the digital driving method is described in more detail with reference to FIG. 3 below.

Figure 3:
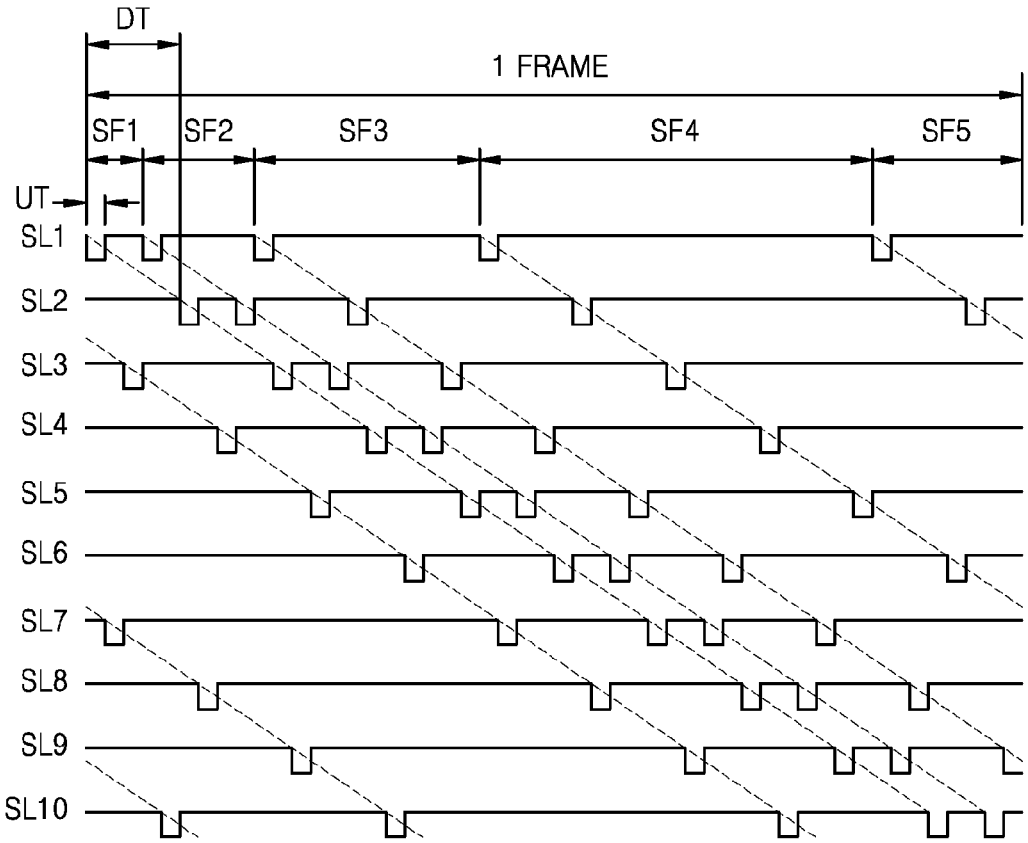
FIG. 3 is a timing diagram of scan signals that are transferred through first to tenth scan lines of the organic light emitting display apparatus of FIG. 1 according to an exemplary embodiment of the present invention.

FIG. 3 is a timing diagram of scan signals that are transferred through scan lines of an organic light emitting display apparatus according to an exemplary embodiment of the present invention.

In the organic light emitting display apparatus 10 operating in the digital driving method, one frame may include a plurality of subfields and the length (for example, a display duration time) of each subfield may be determined according to a weighting set in each subfield.

As illustrated in FIG. 3, one frame includes five subfields (e.g., first to fifth subfields SF1 to SF5), however, aspects of the invention are not limited thereto. The pixel PX of the organic light emitting display apparatus 10 may provide a gray scale through first to fifth bit data. For example, the ratio of lengths of the first to fifth subfields SF1 to SF5 may be 3:6:12:21:8. More specifically, the ratio of lengths of display duration times of the first to fifth bit data may be 3:6:12:21:8.

For example, a data signal having a level corresponding to a logic value of the first bit data may be applied to any one pixel PX connected to the first scan line SL1 at the scan timing that begins the first subfield SF1. The pixel PX may or may not emit light during the first subfield SF1 according to a logic value of the first bit data. In this manner, i-th bit data is applied to the pixel PX at the scan timing beginning an i-th subfield SFi (where i is a natural number that is from 1 to 5), and the pixel PX may or may not emit light during the i-th subfield SFi according to a logic value of the i-th bit data. In the following description, a data signal having a level corresponding to a logic value of bit data may be applied to the pixel PX. Such operation may be simply referred to as that the bit data is applied to the pixel PX. However, aspects of the invention are not limited thereto, such that other descriptions may be used.

The fifth subfield SF5 may be a non-light emitting time. The fifth bit data may be non-active (or non-light emitting) bit data. For example, a data signal having the second logic level may be applied to the pixel PX at the scan timing that begins the fifth subfield SF5. In this case, the pixel PX may provide a gray scale by using the first to fourth bit data during one frame.

Referring to FIG. 3, one frame may include at least ten delay times DT since the number of scan lines SL1 to SL10 is ten. Scan timings of the scan lines SL1 to SL10 may be delayed by one delay time DT. For example, scan timings of an (i+1)-th scan line SL(i+1) may be delayed by one delay time DT compared to scan timings of an i-th scan line SLi.

One delay time DT may be time-divided into five unit times UT, and thus, only one scan line may be selected in one unit time UT. More specifically, one delay time DT may include five unit times UT and one frame may include fifty unit times UT.

For example, as illustrated in FIG. 3, during a first delay time DT including first to fifth unit times UT, the first scan line SL1 may be selected during the first unit time UT and thus the first bit data may be applied to a pixel PX connected to the first scan line SL1. During the second unit time UT, the fourth bit data may be applied to a pixel PX connected to the seventh scan line SL7. During the third unit time UT, the fifth bit data may be applied to a pixel PX connected to the third scan line SL3. During the fourth unit time UT, the second bit data may be applied to a pixel PX connected to the first scan line SL1. During the fifth unit time UT, the third bit data may be applied to a pixel PX connected to the tenth scan line SL10.

The organic light emitting display apparatus 10 illustrated in FIG. 1 includes m data lines DL1 to DLm. During the first unit time UT, m bits of first line data corresponding to the first bit data are applied to m pixels PX connected to the first scan line SL1 through the m data lines DL1 to DLm. During the second unit time UT, m bits of second line data corresponding to the fourth bit data are applied to m pixels PX connected to the seventh scan line SL7 through the m data lines DL1 to DLm. During the third unit time UT, m bits of third line data corresponding to the fifth bit data are applied to m pixels PX connected to the third scan line SL3. During the fourth unit time UT, m bits of fourth line data corresponding to the second bit data are applied to m pixels PX connected to the first scan line SL1. During the fifth unit time UT, m bits of fifth line data corresponding to the third bit data are applied to m pixels PX connected to the tenth scan line SL10.

Figure 4:
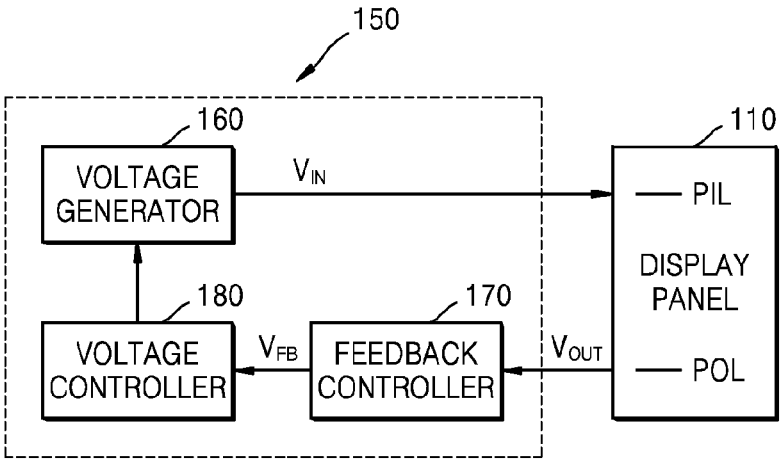
FIG. 4 is a block diagram of a power supplier of the organic light emitting display apparatus of FIG. 1 according to an exemplary embodiment of the present invention.

FIG. 4 is a block diagram of a power supplier of the organic light emitting display apparatus of FIG. 1 according to an exemplary embodiment of the present invention.

Referring to FIG. 4, the power supplier 150 includes a voltage generator 160, a feedback controller 170, and a voltage controller 180.

A display panel 110 includes at least one power input line PIL to which the first power supply voltage ELVDD or the second power supply voltage ELVSS is inputted, and at least one power output line POL connected to the at least one power input line PIL.

The voltage generator 160 may receive at least one of the first and second power supply voltages ELVDD and ELVSS as an input voltage $V_{IN}$. The voltage generator 160 may provide or transmit the input voltage $V_{IN}$ to the power input line PIL of the display panel 110. The power input line PIL may include a first power input line receiving the first power supply voltage ELVDD and a second power input line receiving the second power supply voltage ELVSS.

The feedback controller 170 may detect a feedback voltage $V_{FB}$ based on an output voltage $V_{OUT}$ of the power output line POL, which may be connected to the power input line PIL. The power output line POL may include a first power output line connected to the first power input line and a second power output line connected to the second power input line.

The voltage controller 180 may detect a voltage level change of at least one of the first and second power supply voltages ELVDD and ELVSS based on the feedback voltage $V_{FB}$.

The voltage generator 160 may receive an output of the voltage controller 180, which may be at least one of the first and second power supply voltages ELVDD and ELVSS. The voltage generator 160 may provide or transmit the varied power supply voltage to the power input line PIL as the input voltage $V_{IN}$. A pulse width modulation (PWM) method may be used as a method of boosting or decreasing a power supply voltage. However, aspects of the present invention are not limited thereto, such that various voltage conversion methods may be used as the method of boosting or decreasing a power supply voltage.

Figure 5:
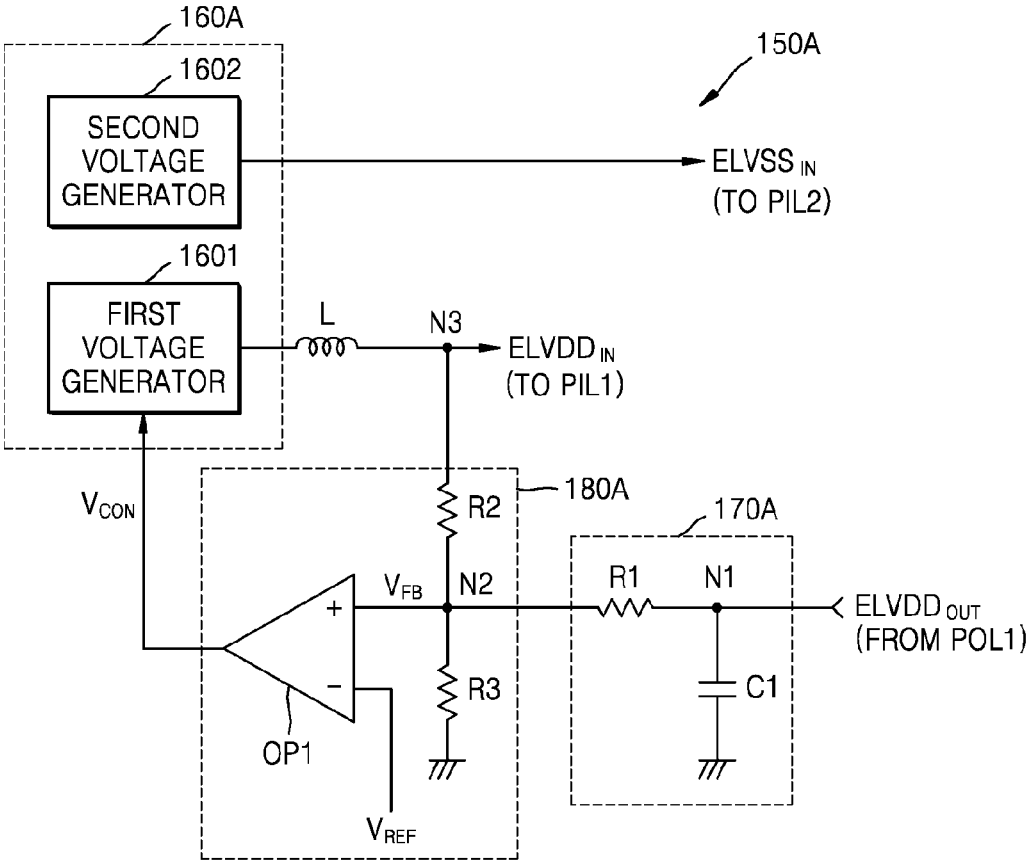
FIGS. 5 through 8 are diagrams illustrating a circuit configuration of the power supplier of FIG. 4 according to exemplary embodiments of the present invention.

FIG. 5 is a diagram illustrating a circuit configuration of the power supplier of FIG. 4 according to an exemplary embodiment of the present invention.

Referring to FIG. 5, a power supplier 150A includes a voltage generator 160A, a feedback controller 170A, and a voltage controller 180A.

The voltage generator 160A includes a first voltage generator 1601 and a second voltage generator 1602.

The first voltage generator 1601 may generate the first power supply voltage ELVDD. The first power supply voltage ELVDD may be inputted to a first power input line PIL1 of the display panel 110 as a first input voltage $ELVDD_{IN}$ through an inductor L.

The inductor L has one terminal connected to an output terminal of the first voltage generator 1601, which may output the first power supply voltage ELVDD, and the other terminal connected to the first power input line PIL1 to which the first input voltage $ELVDD_{IN}$ may be inputted. The first power supply voltage ELVDD may be stably supplied as the first input voltage $ELVDD_{IN}$ by the inductor L.

The second voltage generator 1602 may generate the second power supply voltage ELVSS and input or transmit the generated second power supply voltage ELVSS to a second power input line PIL2 of the display panel 110 as a second input voltage $ELVSS_{IN}$. The display panel 110 may further include a second power output line connected to the second power input line PIL2. The second power input line PIL2 may be formed on a common electrode connected in common to light emitting devices of pixels in the display panel 110 or may be electrically connected to the common electrode. The second power supply voltage ELVSS may be a ground voltage, and the second voltage generator 1602 may be a ground power supply. For example, the second voltage generator 1602 may be the ground of a printed circuit board (PCB).

The feedback controller 170A may output the feedback voltage $V_{FB}$ based on a first output voltage $ELVDD_{OUT}$ of a first power output line POL1, which may be connected to the first power input line PIL1. The feedback controller 170A includes a first resistor R1 and a first capacitor C1.

The first resistor R1 has one terminal connected to the first power output line POL1 and the other terminal connected to a second node N2. The first capacitor C1 has one terminal connected to the first power output line POL1 and the other terminal connected to a first ground.

The first output voltage $ELVDD_{OUT}$ is output to a first node N1 to which the one terminal of the first resistor R1 and the one terminal of the first capacitor C1 are connected. The noise of the first output voltage $ELVDD_{OUT}$ may be removed by the first capacitor C1, and the first output voltage $ELVDD_{OUT}$ may be detected as the feedback voltage $V_{FB}$ at the second node N2 by the first resistor R1.

The voltage controller 180A may detect a level change of the first power supply voltage ELVDD based on the feedback voltage $V_{FB}$. The voltage controller 180A includes a second resistor R2 and a third resistor R3, connected in series, and a first amplifier OP1.

The second resistor R2 has one terminal connected to the first power input line PIL1 and the other terminal connected to the one terminal of the third resistor R3. The third resistor R3 has one terminal connected to the other terminal of the second resistor R2 and the other terminal connected to a second ground. The second resistor R2 and the third resistor R3 are connected in series between the third node N3 and the second ground.

A voltage may correspond to a voltage difference between the first input voltage $ELVDD_{IN}$ and the ground voltage, and divided by the second resistor R2 and the third resistor R3. The feedback voltage $V_{FB}$ at the second node N2, which may be a division node, has a voltage value corresponding to a voltage difference between the first input voltage $ELVDD_{IN}$ and the ground voltage in view of resistance values of the first through third resistors R1, R2, and R3. The feedback voltage $V_{FB}$ may be adjusted according to the resistance value of the first resistor R1 and the resistance value of the second resistor R2.

The first amplifier OP1 has a first input terminal (+) to which the feedback voltage $V_{FB}$ may be inputted, a second input terminal (−) to which a reference voltage $V_{REF}$ may be inputted, and an output terminal that may output a voltage control signal $V_{CON}$ having a high level or low level according to the result of a comparison between the feedback voltage $V_{FB}$ and the reference voltage $V_{REF}$.

The first amplifier OP1 may output the voltage control signal $V_{CON}$ having the high level when the feedback voltage $V_{FB}$ is higher than the reference voltage $V_{REF}$, and may output the voltage control signal $V_{CON}$ having the low level when the feedback voltage $V_{FB}$ is lower than the reference voltage $V_{REF}$.

The first voltage generator 1601 may receive the voltage control signal $V_{CON}$ from an output terminal of the first amplifier OP1, and determine a voltage level change of the first power supply voltage ELVDD in the display panel 110 according to the level of the voltage control signal $V_{CON}$. When the first power supply voltage ELVDD rises in the display panel 110, the first voltage generator 1601 may decrease the first power supply voltage ELVDD and output a decreased first power supply voltage. When the first power supply voltage ELVDD falls in the display panel 110, the first voltage generator 1601 may boost the first power supply voltage ELVDD and output a boosted first power supply voltage. The first power supply voltage ELVDD boosted or decreased by the first voltage generator 1601 may be inputted to the first power input line PIL as the first input voltage $ELVDD_{IN}$ through the inductor L.

Figure 6:
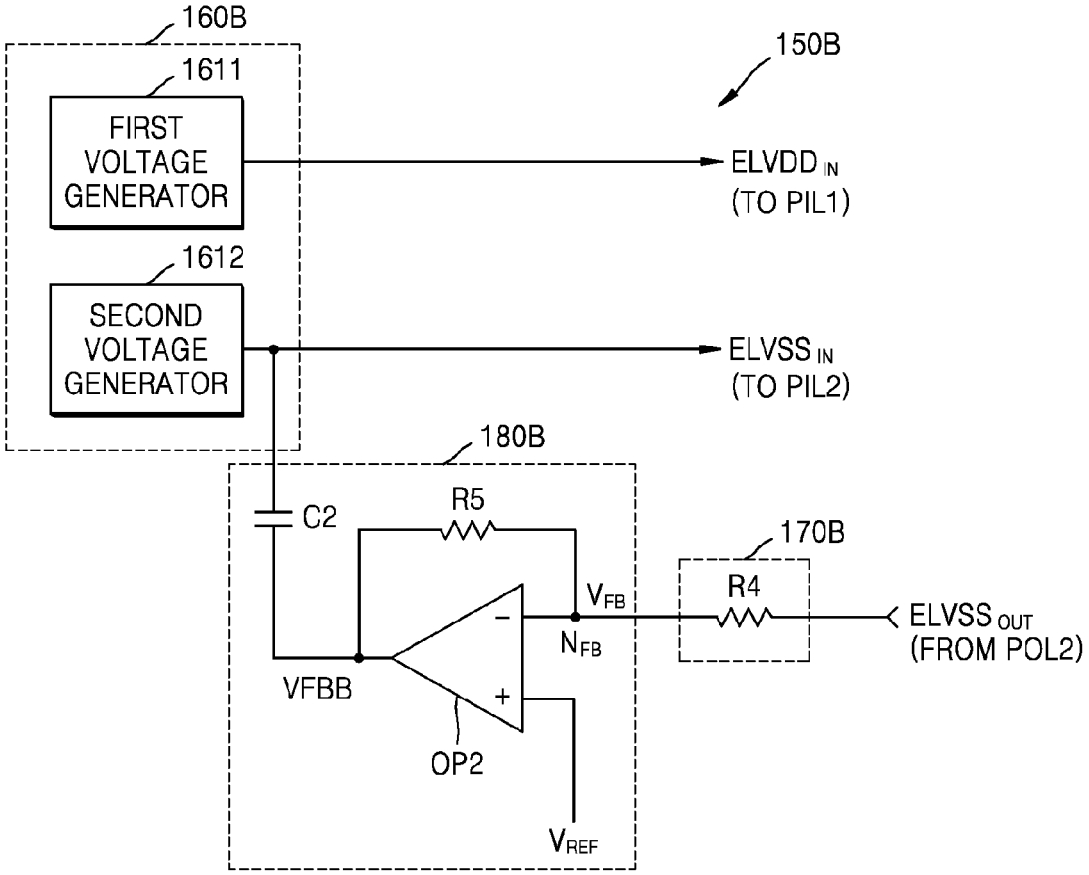

FIG. 6 is a diagram illustrating a circuit configuration of the power supplier of FIG. 4 according to an exemplary embodiment of the present invention.

Referring to FIG. 6, a power supplier 150B includes a voltage generator 160B, a feedback controller 170B, and a voltage controller 180B.

The voltage generator 160B includes a first voltage generator 1611 and a second voltage generator 1612.

The first voltage generator 1611 may generate the first power supply voltage ELVDD. The first power supply voltage ELVDD may be inputted to a first power input line PIL1 of the display panel 110 as a first input voltage $ELVDD_{IN}$.

The second voltage generator 1612 may generate the second power supply voltage ELVSS and input the generated second power supply voltage ELVSS to a second power input line PIL2 of the display panel 110 as a second input voltage $ELVSS_{IN}$. The second power supply voltage ELVSS may be a ground voltage, and the second voltage generator 1612 may be a ground power supply, e.g., the ground of a PCB.

The feedback controller 170B outputs a feedback voltage $V_{FB}$ based on a second output voltage $ELVSS_{OUT}$ of a second power output line POL2, which may be connected to the second power input line PIL2. The feedback controller 170B includes a fourth resistor R4.

The fourth resistor R4 has one terminal connected to the second power output line POL2 and the other terminal connected to a feedback node $N_{FB}$.

The second output voltage $ELVSS_{OUT}$ is output to the one terminal of the fourth resistor R4. The second output voltage $ELVSS_{OUT}$ may be detected as the feedback voltage $V_{FB}$ at the feedback node $N_{FB}$ by the fourth resistor R4.

The voltage controller 180B may detect a level change of the second power supply voltage ELVSS based on the feedback voltage $V_{FB}$. The voltage controller 180B includes a fifth resistor R5, a second amplifier OP2, and a second capacitor C2.

The second amplifier OP2 has a first input terminal (−) to which the feedback voltage $V_{FB}$ may be inputted, a second input terminal (+) to which a reference voltage $V_{REF}$ may be inputted, and an output terminal that may output an inverted voltage VFBB, which may be obtained by inverting and amplifying the feedback voltage $V_{FB}$. The reference voltage $V_{REF}$ may be a ground voltage.

The second amplifier OP2 may be an inverted amplifier that outputs the inverted voltage VFBB obtained by inverting the feedback voltage $V_{FB}$ when the feedback voltage $V_{FB}$ is higher or lower than the reference voltage $V_{REF}$.

The fifth resistor R5 has one terminal connected to the first input terminal (−) of the second amplifier OP2 and the other terminal connected to the output terminal of the second amplifier OP2.

The second capacitor C2 has one terminal connected to the output terminal of the second amplifier OP2 and the other terminal connected to an output terminal of the second voltage generator 1612 or the second power input line PIL2. The second capacitor C2 is coupled to the output terminal of the second voltage generator 1612.

The second power supply voltage ELVSS may be adjusted, for example, boosted or decreased, by the coupling of the second capacitor C2, and the boosted or decreased second power supply voltage may be inputted to the second power input line PIL2 as the second input voltage $ELVSS_{IN}$.

Figure 7:
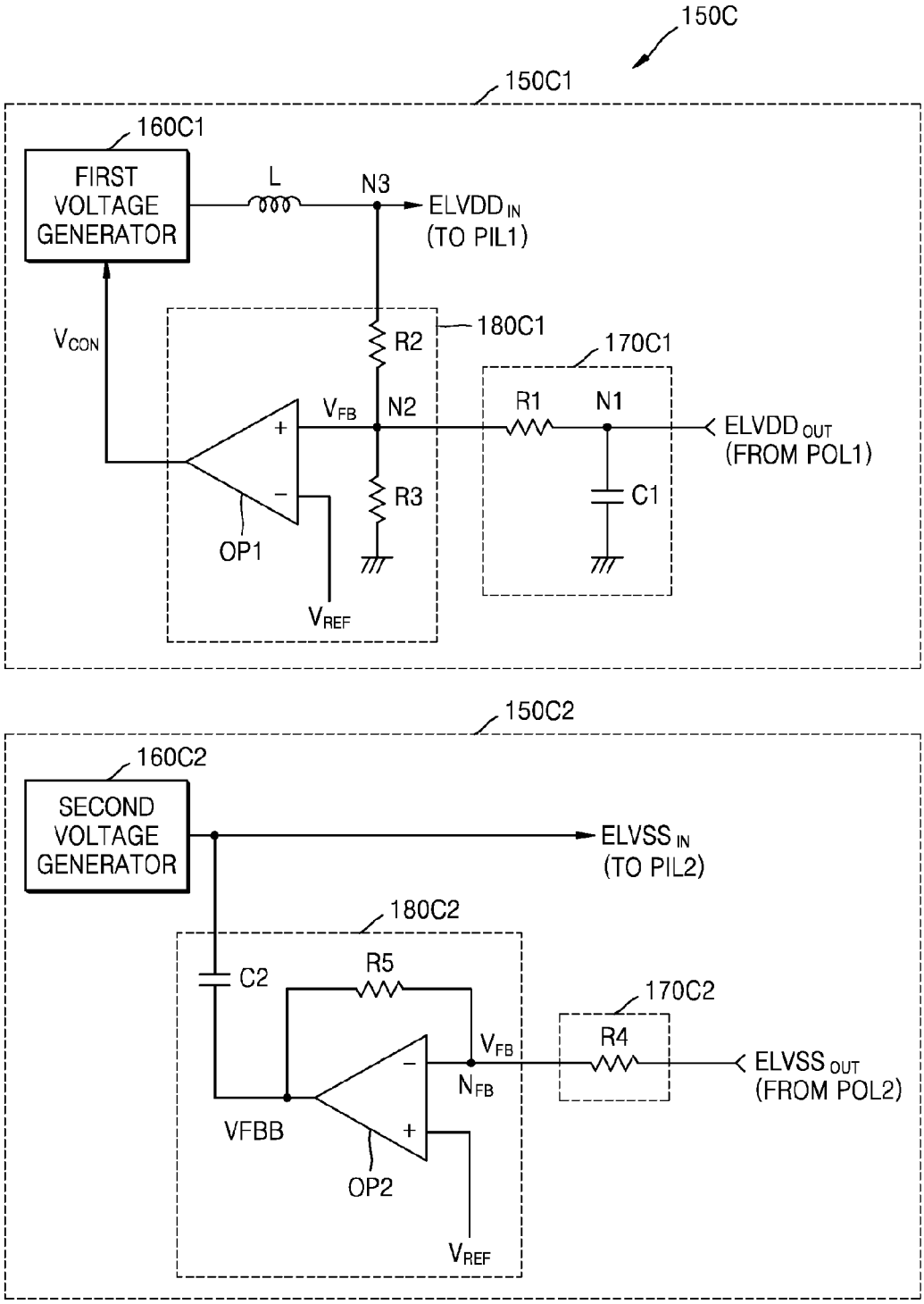

FIG. 7 is a diagram illustrating a circuit configuration of the power supplier of FIG. 4 according to an exemplary embodiment of the present invention.

Referring to FIG. 7, a power supplier 150C includes a first power supplier 150C1 and a second power supplier 150C2.

The first power supplier 150C1 includes a first voltage generator 160C1, a first feedback controller 170C1, and a first voltage controller 180C1. The first voltage generator 160C1, the first feedback controller 170C1, and the first voltage controller 180C1 of the first power supplier 150C1 may be substantially similar to or the same as the first voltage generator 1601, the feedback controller 170A, and the voltage controller 180A, respectively, illustrated in FIG. 5. Thus, a more detailed description of the first power supplier 150C1 is omitted.

The second power supplier 150C2 includes a second voltage generator 160C2, a second feedback controller 170C2, and a second voltage controller 180C2. The second voltage generator 160C2, the second feedback controller 170C2, and the second voltage controller 180C2 of the second power supplier 150C2 may be substantially similar or the same as the second voltage generator 1612, the feedback controller 170B, and the voltage controller 180B, respectively, illustrated in FIG. 6. Thus, a more detailed description of the second power supplier 150C2 is omitted.

By detecting a level change through the feedback of the first and second power supply voltages ELVDD and ELVSS according to the exemplary embodiment of FIG. 7, the first power supply voltage ELVDD and the second power supply voltage ELVSS may be corrected to thereby reduce or minimize a voltage difference deviation between the first power supply voltage ELVDD and the second power supply voltage ELVSS.

Figure 8:
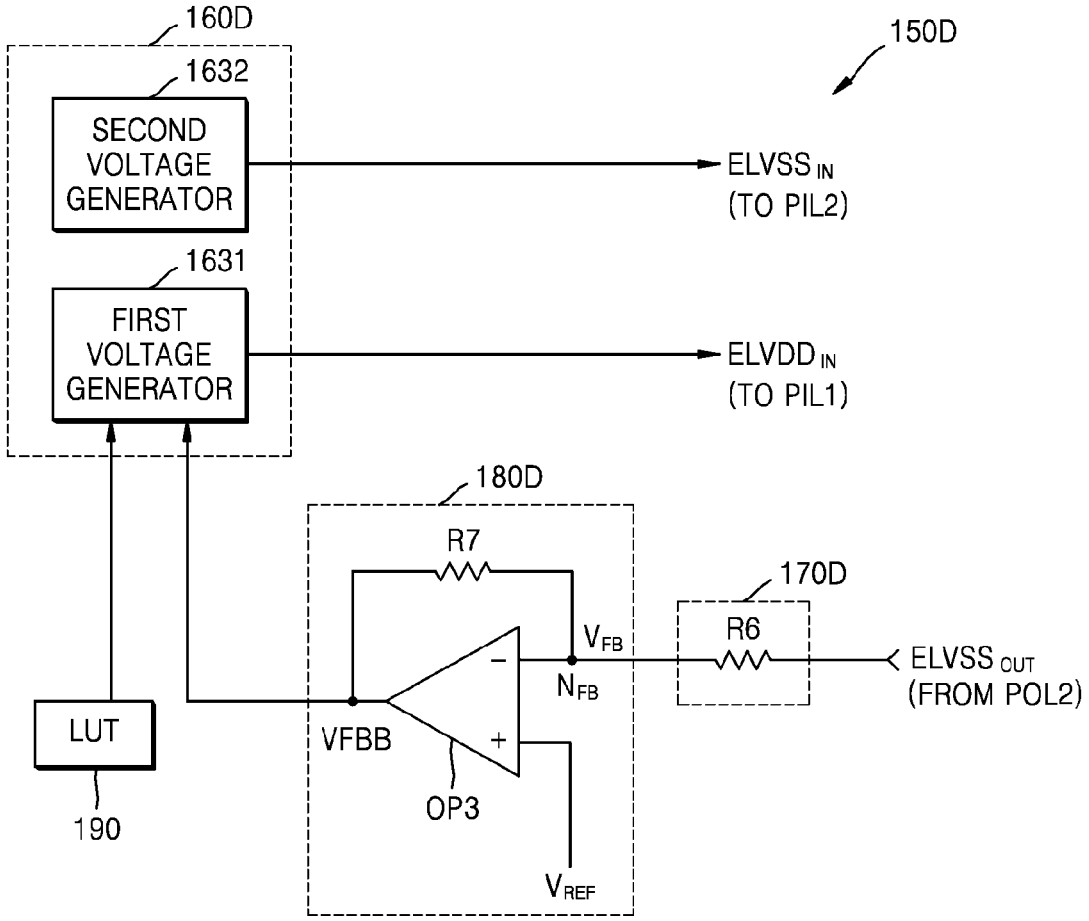

FIG. 8 is a diagram illustrating a circuit configuration of the power supplier of FIG. 4 according to an exemplary embodiment of the present invention.

Referring to FIG. 8, a power supplier 150D includes a voltage generator 160D, a feedback controller 170D, a voltage controller 180D, and a lookup table (LUT) 190.

The voltage generator 160D includes a first voltage generator 1631 and a second voltage generator 1632.

The second voltage generator 1631 may generate the second power supply voltage ELVSS. The second power supply voltage ELVSS may be inputted to a second power input line PIL2 of the display panel 110 as a second input voltage $ELVSS_{IN}$. The second power supply voltage ELVSS may be a ground voltage, and the second voltage generator 1632 may be the ground of a PCB.

The first voltage generator 1631 may generate the first power supply voltage ELVDD. The first power supply voltage ELVDD may be inputted to a first power input line PIL1 of the display panel 110 as a first input voltage $ELVDD_{IN}$.

The feedback controller 170D may output a feedback voltage $V_{FB}$ based on a second output voltage $ELVSS_{OUT}$ of a second power output line POL2, which may be connected to the second power input line PIL2. The feedback controller 170D includes a sixth resistor R6.

The sixth resistor R6 has one terminal connected to the second power output line POL2 and the other terminal connected to a feedback node $N_{FB}$.

The second output voltage $ELVSS_{OUT}$ may be outputted or transmitted to the one terminal of the sixth resistor R6. The second output voltage $ELVSS_{OUT}$ may be detected as the feedback voltage $V_{FB}$ at the feedback node $N_{FB}$ by the sixth resistor R6.

The voltage controller 180D may determine whether to boost or decrease the second power supply voltage ELVSS based on the feedback voltage $V_{FB}$. The voltage controller 180D includes a seventh resistor R7 and a third amplifier OP3.

The third amplifier OP3 has a first input terminal (−) to which the feedback voltage $V_{FB}$ may be inputted, a second input terminal (+) to which a reference voltage $V_{REF}$ may be inputted, and an output terminal that may output an inverted voltage VFBB obtained by inverting and amplifying the feedback voltage $V_{FB}$. The reference voltage $V_{REF}$ may be a ground voltage.

The second amplifier OP3 may output the inverted voltage VFBB obtained by inverting the feedback voltage $V_{FB}$ when the feedback voltage $V_{FB}$ is higher or lower than the reference voltage $V_{REF}$.

The seventh resistor R7 has one terminal connected to the first input terminal (−) of the third amplifier OP3 and the other terminal connected to the output terminal of the third amplifier OP3.

The first voltage generator 1631 may receive the inverted voltage VFBB from an output terminal of the third amplifier OP3. The first voltage generator 1631 may determine a change value of the first power supply voltage ELVDD, which may correspond to the inverted voltage VFBB, from the LUT 190. The first voltage generator 1631 may boost or decrease the first power supply voltage ELVDD based on the determined change value of the first power supply voltage ELVDD.

The LUT 190 may match an optimum first power supply voltage ELVDD, which may be calculated beforehand from an inverted voltage VFBB corresponding to a level change of the second power supply voltage ELVSS, to the inverted voltage VFBB. Further, the LUT 190 may store the relation of the matched optimum first power supply voltage ELVDD and inverted voltage VFBB. According to exemplary embodiments of the present invention, a graph, which may indicate a relation between an inverted voltage VFBB corresponding to the second power supply voltage ELVSS and a previously calculated optimum first power supply voltage ELVDD, may also be used.

Figure 9:
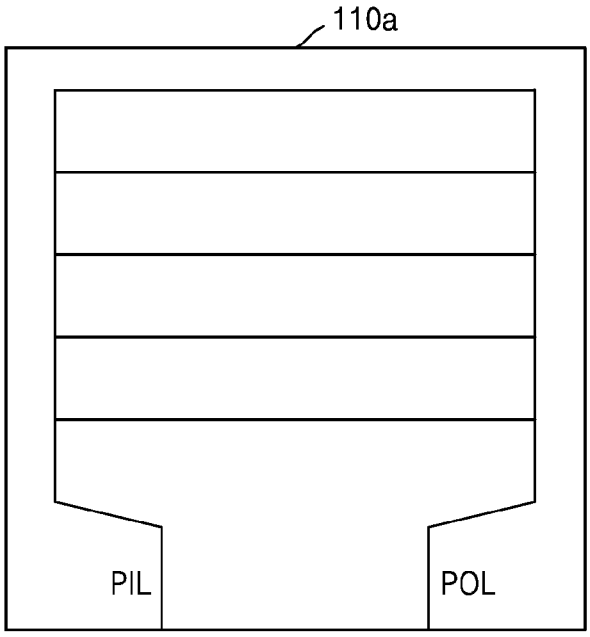
FIGS. 9 through 14 each are a schematic diagram illustrating a portion of a display panel according to exemplary embodiments of the present invention.

FIG. 9 is a schematic diagram illustrating a portion of a display panel 110*a* according to an exemplary embodiment of the present invention.

Referring to FIG. 9, a power input line PIL, to which a power supply voltage may be inputted, and a power output line POL, which may be connected to the power input line PIL, are disposed in the display panel 110*a*.

The power input line PIL may be a first power input line PIL1, to which the first power supply voltage ELVDD may be inputted, or a second power input line PIL2 to which the second power supply voltage ELVSS may be inputted.

The power output line POL may be a first power output line POL1, which may be connected to the first power input line PILL or a second power output line POL2, which may be connected to the second power input line PIL2.

The power input line PIL extends to a plurality of branch power lines branched in a row direction, and the power output line POL is connected to the plurality of branch power lines. Although not illustrated, according to aspects of the invention, a plurality of branch power lines may extend in a column direction from the top of the power input line PIL.

Although the power output line POL is illustrated in the embodiment of FIG. 9 as being connected to all of the plurality of branch power lines, aspects of the invention are not limited thereto. For example, the power output line POL may be connected to at least one of the plurality of branch power lines.

In the second power input line PIL2, branch power lines may be connected in common to electrodes (e.g., cathode electrodes) of light emitting devices of a plurality of pixels PX, and may be a common electrode formed on the entire surface of the display panel 110*a*.

The power supplier 150 may input the first power supply voltage ELVDD or the second power supply voltage ELVSS to the power input line PIL and detect a feedback voltage from an output voltage of the power output line POL. The power supplier 150 may detect a level change, which may occur according to time, of at least one of the first and second power supply voltages ELVDD and ELVSS, based on the feedback voltage. Further, the power supplier 150 may either boost or decrease at least one of the first and second power supply voltages ELVDD and ELVSS and input the boosted or decreased power supply voltage to the display panel 110*a*. The configuration and operation of the power supplier 150 have been described above with reference to FIGS. 4 to 8 and thus are omitted.

Figure 10:
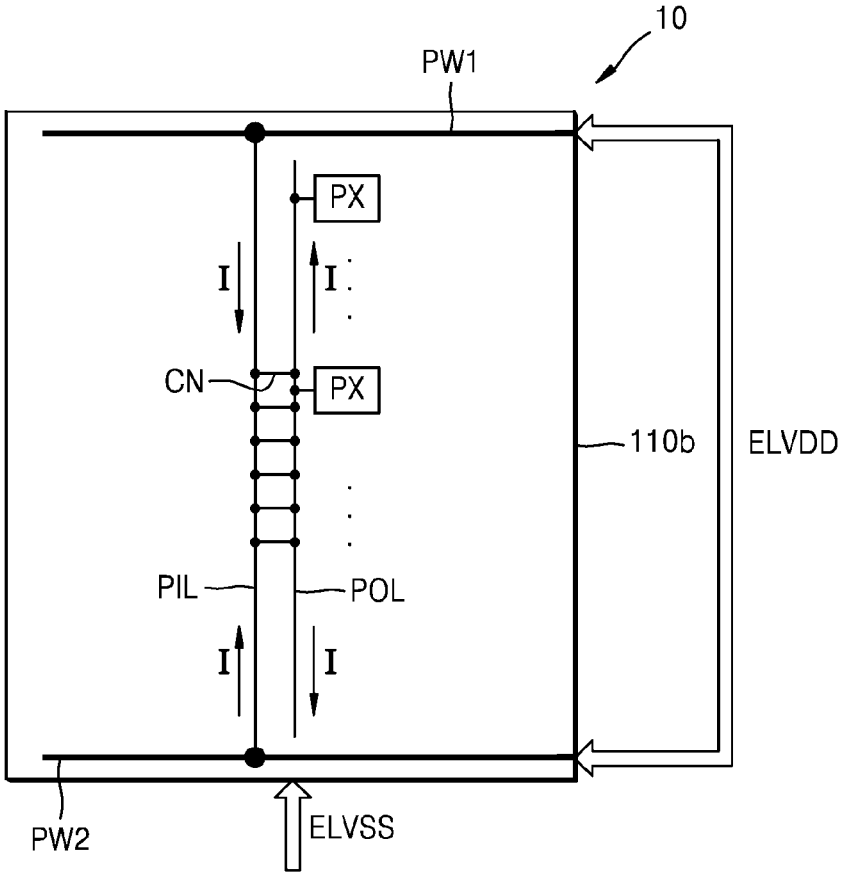

FIG. 10 is a schematic diagram illustrating a portion of a display panel 110*b* according to an exemplary embodiment of the present invention.

Referring to FIG. 10, the display panel 110*b* may include at least one power wire (e.g., a first power line PW1 and/or a second power wire PW2) to which a power supply voltage may be applied, a power input line PIL connected to the at least one power wire, at least one connecting portion CN connected to the power input line PIL, and a power output line POL connected to the at least one connecting portion CN and pixels PX to provide the power supply voltage to the pixels PX. The power supply voltage may be either the first power supply voltage ELVDD or the second power supply voltage ELVSS.

The first and second power wires PW1 and PW2 may be disposed outside a pixel area in which the pixels PX of the display panel 110 are arranged. The first power supply voltage ELVDD or the second power supply voltage ELVSS, which may be generated by the power supplier 150, may be directly applied to the first and second power wire PW1 and PW2. Since the first and second power wires PW1 and PW2 may have low line resistance compared to the power input line PIL and the power output line POL, a voltage drop occurring due to the flow of a current may be small and/or negligible. Although, in FIG. 10, the first power wire PW1 is illustrated as being disposed at the top of the display panel 110*b* and the second power wire PW2 is illustrated as being disposed at the bottom of the display panel 110*b*, power wires may be disposed at a left side and/or right side of the display panel 110*b* or be disposed to surround the display panel 110*b*, based on a design of the display panel 110*b*. In addition, one of the first and second power wires PW1 and PW2 may be omitted.

Although only one power input line PIL is illustrated in FIG. 10, a plurality of power input lines PIL may be arranged on the display panel 110*b* and may be connected to at least one of the first and second power wires PW1 and PW2. As illustrated in FIG. 10, the power input line PIL may be connected between the first power wire PW1 and the second power wire PW2. The power input line PIL has a first end connected to the first power wire PW1 and a second end connected to the second power wire PW2. When one of the first and second power wires PW1 and PW2 is omitted, the power input line PIL may be connected to the other one of the first and second power wires PW1 and PW2. When a power wire is disposed on a left side and/or right side of the display panel 110*b*, the power input line PIL may extend in a row direction (e.g., a horizontal direction). When a power wire is disposed to surround the display panel 110*b*, the power input line PIL may be arranged in a mesh form.

Although only one power output line POL is illustrated in FIG. 10, a plurality of power output lines POL may be arranged on the display panel 110*b* and be connected to the pixels PX. As illustrated in FIG. 10, the power output line POL may extend in a column direction (e.g., a vertical direction). The power output line POL may extend in a row direction or be arranged in a mesh form. The power output line POL may be disposed across the entire display panel 110*b* to be connected to all pixels PX from a pixel of a first row on the display panel 110*b* to a pixel of a last row (an n-th row in FIG. 1) on the display panel 110*b*. However, the power output line POL may not be directly connected to the first and second power wires PW1 and PW2.

Connecting portions CN may electrically connect the power input line PIL and the power output line POL. The connecting portions CN may be connected to an intermediate portion of the power output line POL. According to aspects of the invention, the intermediate portion of the power output line POL may refer to portions adjacent to a central point of the power output line POL in a longitudinal direction of the power output line POL. The number of connecting portions CN connecting one power input line PIL to one power output line POL may be selected between 5% and 30% of the number (e.g., "n" in FIG. 1) of rows of the pixels PX. Further, the number of connecting portions CN that may be connected to one power output line POL may be selected between 5% and 10% of the number of rows of the pixels PX. However, the power input line PIL and the power output line POL may also be connected to each other by one connecting portion CN.

Referring to FIG. 10, at least one of the first and second power supply voltages ELVDD and ELVSS generated by the power supplier 150 may be applied to the first and second power wires PW1 and PW2 and may be applied to the pixels PX through the power input line PIL, the connecting portions CN, and the power output line POL.

In the power input line PIL, a current I may flow from both ends toward the connecting portions CN of the central portion. The current I may flow to the power output line POL through the connecting portions CN. In the power output line POL, the current I may flow from the central portion, in which the connecting portions CN may be disposed, to both ends of the power output line POL.

The power supplier 150 may detect a feedback voltage from an output voltage of the power output line POL. The power supplier 150 may detect a level change, which may occur according to time, of at least one of the first and second power supply voltages ELVDD and ELVSS, based on the feedback voltage. Further, the power supplier 150 may boost or decrease at least one of the first and second power supply voltages ELVDD and ELVSS and input the boosted or decreased power supply voltage to the display panel 110*a*. The configuration and operation of the power supplier 150 have been described above with reference to FIGS. 4 to 8 and thus are omitted.

Figure 11:
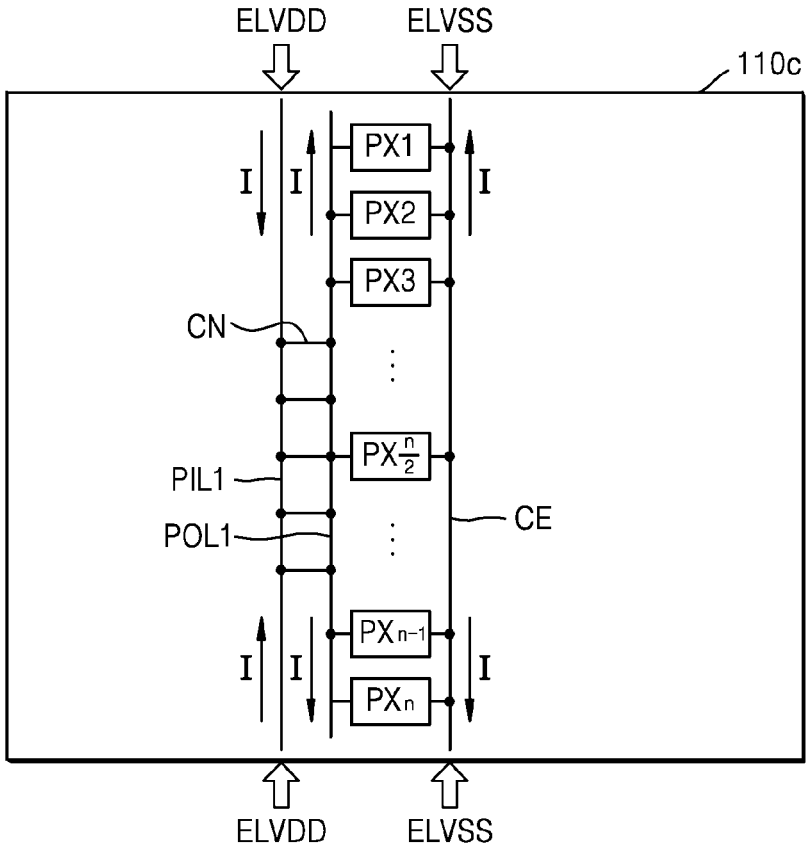

FIG. 11 is a schematic diagram illustrating a portion of a display panel 110*c* according to an exemplary embodiment of the present invention.

Referring to FIG. 11, the display panel 110*c* includes a plurality of pixels PX1 to PXn, a first power input line PILL connecting portions CN, a first power output line POL1, and a common electrode CE. A first power supply voltage ELVDD may be supplied to the plurality of pixels PX1 to PXn through the first power input line PILL and a second power supply voltage ELVSS may be supplied to the plurality of pixels PX1 to PXn through the common electrode CE. The first power input line PILL the connecting portions CN, and the first power output line POL1 have been described above with reference to FIG. 10, and thus, repeated descriptions thereof are omitted.

Although the first power supply voltage ELVDD may be applied through top and bottom ends of the first power input line PIL1, the first power supply voltage ELVDD may be supplied from a central portion of the first power output line POL1 toward top and bottom ends of the first power output line POL1 through the connecting portions CN. Accordingly, a current I may flow from the central portion of the first power output line POL1 toward both ends of the first power output line POL1.

The second power supply voltage ELVSS may be applied through top and bottom ends of the common end CE. The common electrode CE may be formed to cover the pixels PX1 to PXn on the display panel 100*c*.

The power supplier 150 may detect a feedback voltage from an output voltage of the first power output line POL1. The power supplier 150 may detect a level change, which may occur according to time, of the first power supply voltages ELVDD, based on the feedback voltage. Further, the power supplier 150 may boost or decrease at least one of the first and second power supply voltages ELVDD and ELVSS and input the boosted or decrease power supply voltage to the display panel 110*c*. The configuration and operation of the power supplier 150 have been described above with reference to FIGS. 4 to 8 and thus are omitted.

Figure 12:
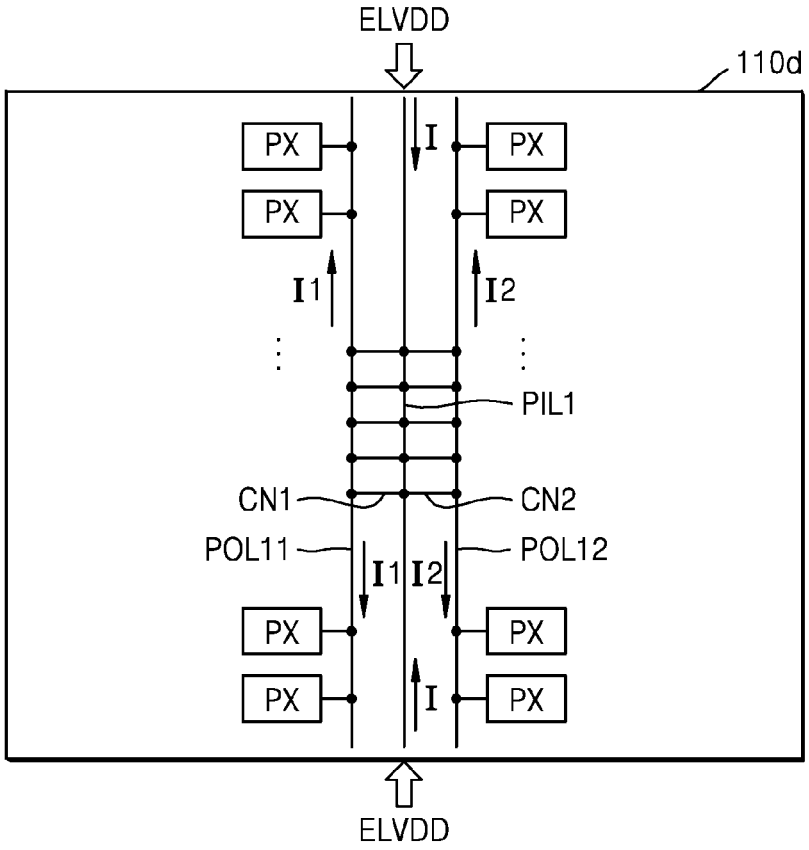

FIG. 12 is a schematic diagram illustrating a portion of a display panel 110*d* according to an exemplary embodiment of the present invention.

Referring to FIG. 12, the display panel 110*d* includes a first power input line PILL first and second connecting portions CN1 and CN2 connected to the first power supply input PIL1, a first-first power output line POL11 connected to one or more of the first connecting portions CN1, and a first-second power output line POL12 connected to one or more of the second connecting portions CN2, to supply a first power supply voltage ELVDD to pixels PX.

The display panel 110*d* includes pixels PX connected to the first-first power output line POL11 and pixels PX connected to the first-second power output line POL12. Although not shown in FIG. 12, a common electrode CE for supplying a second power supply voltage ELVSS may be connected to the pixels PX.

The first connecting portions CN1 are connected to an intermediate portion of the first-first power output line POL1, and the second connecting portions CN2 are connected to an intermediate portion of the first-second power output line POL2. A first current I1 may be consumed by the pixels PX, which may be connected to the first-first power output line POL1, and a second current I2 that may be consumed by the pixels PX, which may be connected to the first-second power output line POL2, are supplied through the first power input line PIL1.

The power supplier 150 may detect a feedback voltage from an output voltage of the first-first power output line POL11 and/or an output of the first-second power output line POL12. The power supplier 150 may detect a level change, which may occur according to time, of the first power supply voltage ELVDD, based on the feedback voltage. Further, the power supplier 150 may boost or decrease at least one of the first and second power supply voltages ELVDD and ELVSS and input the boosted or decreased power supply voltage to the display panel 110*d*. The configuration and operation of the power supplier 150 have been described above with reference to FIGS. 4 to 8 and thus are omitted.

Figure 13:
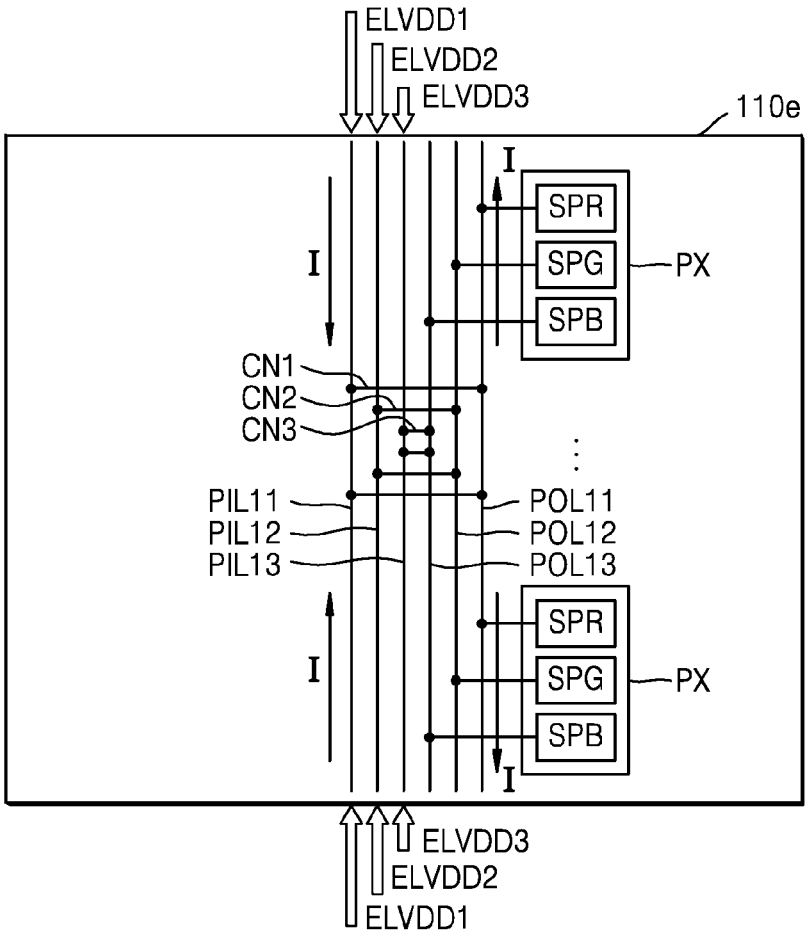

FIG. 13 is a schematic diagram illustrating a portion of a display panel 110*e* according to an exemplary embodiment of the present invention.

Referring to FIG. 13, the display panel 110*e* includes a plurality of pixels PX, each of which includes first through third sub-pixels SPR, SPG, and SPB. The first sub-pixel SPR may emit red light, the second sub-pixel SPG may emit green light, and the third sub-pixel SPB may emit blue light. Each pixel PX may further include a sub-pixel emitting white light.

A first-first power supply voltage ELVDD1 may be applied to the first sub-pixel SPR through a first-first power input line PIL11, first connecting portions CN1 connected to the first-first power input line PIL11, and a first-first power output line POL11 connected to the first connecting portions CN1. A first-second power supply voltage ELVDD2 may be applied to the second sub-pixel SPG through a first-second power input line PIL12, second connecting portions CN2 connected to the first-second power input line PIL12, and a first-second power output line POL12 connected to the second connecting portions CN2. A first-third power supply voltage ELVDD3 may be applied to the third sub-pixel SPB through a first-third power input line PIL13, third connecting portions CN3 connected to the first-third power input line PIL13, and a first-third power output line POL13 connected to the third connecting portions CN3. The first-first power supply voltage ELVDD1, the first-second power supply voltage ELVDD2, and the first-third power supply voltage ELVDD3 may have different voltage levels. For example, the voltage level of the first-first power supply voltage ELVDD1 may be highest, and the voltage level of the first-third power supply voltage ELVDD3 may be lowest.

The first through third connecting portions CN1 to CN3 may be connected to intermediate portions of the first-first through first-third power output lines POL11, POL12, and POL13, respectively. A current I flowing through the first-first power output line POL11 may flow from a central portion thereof toward both ends thereof. Similarly, a current flowing through the first-second power output line POL12 may flow from a central portion thereof toward both ends thereof, and a current flowing through the first-third power output line POL13 may flow from a central portion thereof toward both ends thereof. Although not shown in FIG. 13, a common electrode CE for supplying a second power supply voltage ELVSS may be connected to the pixels PX.

The power supplier 150 may detect a feedback voltage from an output voltage of each of the first-first through first-third power output lines POL11, POL12, and POL3. The power supplier 150 may detect a level change, which may occur according to time, of each of the first-first through first-third power supply voltages ELVDD1 to ELVDD3, based on the feedback voltage. Further, the power supplier 150 may boost or decrease the first-first through first-third power supply voltages ELVDD1 to ELVDD3 and input the boosted or decreased power supply voltages to the display panel 110*e*. The configuration and operation of the power supplier 150 have been described above with reference to FIGS. 4 to 8 and thus are omitted.

Figure 14:
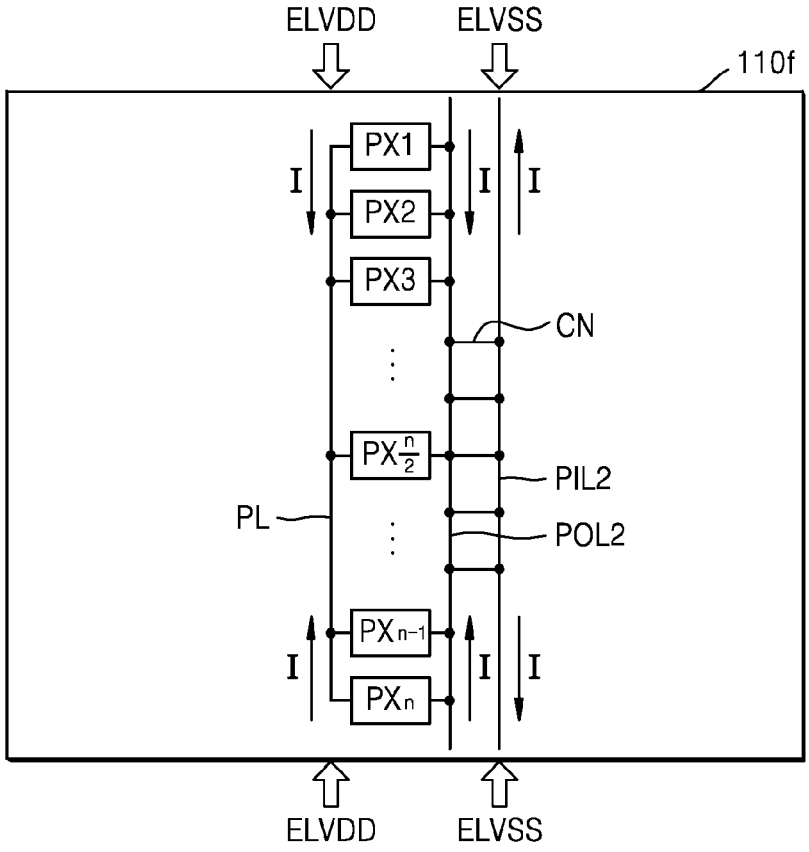

FIG. 14 is a schematic diagram illustrating a portion of a display panel 110*f* according to an exemplary embodiment of the present invention.

Referring to FIG. 14, the display panel 110*f* includes a plurality of pixels PX1 to PXn, a power line PL for supplying a first power supply voltage ELVDD to the plurality of pixels PX1 to PXn, a second power input line PIL for supplying a second power supply voltage ELVSS to the plurality of pixels PX1 to PXn, connecting portions CN, and a second power output line POL. The power line PL extends in a column direction and is connected to pixels PX1 to PXn of the same column. The second power input line PIL, the connecting portions CN, and the second power output line POL have been described above with reference to FIG. 10, and thus, repeated descriptions thereof are omitted. Referring to FIG. 14, the second power input line PIL, the connecting portions CN, and the second power output line POL may be disposed on a common electrode CE or may supply the second power supply voltage to the pixels PX1 to PXn without the common electrode CE.

The first power supply voltage ELVDD may be applied through top and bottom ends of the power line PL. A current that is or is to be consumed by the pixels PX1 to PXn may be introduced from the top and bottom of the power line.

Although the second power supply voltage ELVSS is applied through top and bottom ends of the second power input line PIL2, the second power supply voltage ELVSS is supplied from a central portion of the second power output line POL2 toward top and bottom ends of the second power output line POL2 through the connecting portions CN. Accordingly, a current I flows from both ends of the second power output line POL2 toward the central portion of the second power output line POL2.

The power supplier 150 may detect a feedback voltage from an output voltage of at least one of the top and bottom ends of the second power output line POL2. The power supplier 150 may detect a level change, which may occur according to time, of each of the second power supply voltage ELVSS based on the feedback voltage. Further, the power supplier 150 may boost or decrease at least one of the first and second power supply voltages ELVDD and ELVSS and input the boosted or decrease power supply voltage to the display panel 110*f*. The configuration and operation of the power supplier 150 have been described above with reference to FIGS. 4 to 8 and thus are omitted.

According to various embodiments of the present invention, a power supply voltage may be accurately controlled by feeding back the power supply voltage used in an actual display panel and adjust the voltage level of the power supply voltage, and thus lowering of the brightness of the display panel may be reduced or prevented.

According to various embodiments of the present invention, luminance variation of pixels may be reduced as variation of a level difference of a power supply voltage applied to pixels of an organic light emitting display apparatus is reduced. Accordingly, the quality of images that are displayed by an organic light emitting display apparatus according to various embodiments of the present invention may be improved.

According to exemplary embodiments, the first power supply voltage ELVDD may be supplied to pixels PX from the top and bottom of a display panel through the first and second power wires PW1 and PW2 disposed at the top and bottom of the display panel. Further, the second power supply voltage ELVSS may be supplied to the pixels PX from the top and bottom of the display panel. However, aspects of the invention are not limited thereto and may be applied to other arrangements by using the same principle.

It should be understood that exemplary embodiments described herein should be considered in a descriptive sense only and not for purposes of limitation. Descriptions of features or aspects within an embodiment should typically be considered as available for other similar features or aspects in other embodiments.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A power supply device, comprising:

a feedback controller configured to detect a feedback voltage based on an output voltage of a power output line, the power output line connected by at least one branch power line in a pixel region of a display to a power input line to which a power supply voltage is supplied;

a voltage controller configured to detect a level change of the power supply voltage based on the feedback voltage; and a voltage generator configured to adjust the power supply voltage according to the detected level change.

2. The power supply device of claim 1, wherein the power output line is at least one of a first power output line and a second power output line, wherein the power supply voltage is at least one of a first power supply voltage and a second power supply voltage, the second power supply voltage being lower than the first power supply voltage, wherein the first power output line is connected to a first power input line, to which the first power supply voltage is inputted, and configured to output the first power supply voltage to a pixel of the display panel, and wherein the second power output line is connected to a second power input line, to which the second power supply voltage is inputted, and configured to output the second power supply voltage to the pixel.

3. The power supply device of claim 2, wherein the feedback voltage is determined based on a resistance value of a first resistor and a resistance value of a second resistor, wherein the first resistor is disposed between the first power output line and a first node, and wherein the second resistor is disposed between the first power input line and the first node.

4. The power supply device of claim 3, wherein the voltage controller is configured to determine whether to adjust the first power supply voltage based on a difference between the feedback voltage at the first node and a reference voltage.

5. The power supply device of claim 4, wherein the voltage generator is configured to decrease the first power supply voltage when the feedback voltage is higher than the reference voltage, and to increase the first power supply voltage when the feedback voltage is lower than the reference voltage.

6. The power supply device of claim 2, wherein the feedback controller is configured to detect the feedback voltage based on a second output voltage of the second power output line.

7. The power supply device of claim 6, wherein the voltage controller comprises:

an amplifier configured to output an inverted voltage obtained by inverting and amplifying the feedback voltage; and a capacitor connected between an output of the amplifier and the second power input line.

8. The power supply device of claim 6, wherein the voltage generator is a ground power supply.

9. The power supply device of claim 6, wherein the voltage controller comprises an amplifier configured to output an inverted voltage obtained by inverting and amplifying the feedback voltage.

10. The power supply device of claim 9, wherein the voltage generator is configured to adjust the first power supply voltage based on a change value of the first power supply voltage, wherein the change value corresponds to the inverted voltage.

11. An organic light emitting display apparatus, comprising:

a display panel comprising:

a power input line to which a power supply voltage is input, and a power output line connected to the power input line by at least one branch power line in a pixel region of the display apparatus; and a power supplier configured to detect a feedback voltage based on an output voltage of the power output line, detect a level change of the power supply voltage based on the feedback voltage, and adjust the power supply voltage according the detected level change.

12. The organic light emitting display apparatus of claim 11, wherein:

the power output line is selected from at least one of a first power output line and a second power output line, the first power output line is connected to a first power input line, to which a first power supply voltage is inputted, and configured to output the first power supply voltage to a pixel of the display panel, and the second power output line is connected to a second power input line, to which a second power supply voltage lower than the first power supply voltage is inputted, and configured to output the second power supply voltage to the pixel.

13. The organic light emitting display apparatus of claim 12, wherein the power supplier comprises:

a first resistor connected between a first node, to which a first output voltage of the first power output line is applied, and a node dividing the first power supply voltage, from which the feedback voltage is outputted;

a second resistor connected between the first power input line and the node;

a third resistor connected between the node and ground; and an amplifier configured to compare the feedback voltage with a reference voltage.

14. The organic light emitting display apparatus of claim 13, wherein the power supplier is configured to increase the first power supply voltage when the feedback voltage is lower than the reference voltage, and to decrease the first power supply voltage when the feedback voltage is higher than the reference voltage.

15. The organic light emitting display apparatus of claim 13, wherein the feedback voltage is determined based on a resistance value of the first resistor and a resistance value of the second resistor.

16. The organic light emitting display apparatus of claim 12, wherein the power supplier comprises:

an amplifier configured to output an inverted voltage obtained by inverting and amplifying a feedback voltage of the second power output line; and a capacitor connected between an output of the amplifier and the second power input line.

17. The organic light emitting display apparatus of claim 16, wherein the second power supply voltage is a ground voltage.

18. The organic light emitting display apparatus of claim 12, wherein the power supplier comprises:

an amplifier configured to output an inverted voltage obtained by inverting and amplifying a feedback voltage of the second power output line, and adjust the first power supply voltage based on a change value of the first power supply voltage, wherein the change value corresponds to the inverted voltage.

19. The organic light emitting display apparatus of claim 18, wherein the second power supply voltage is a ground voltage.

20. An organic light emitting display apparatus, comprising:

a display panel comprising:

a first power input line to which a first power supply voltage is input, a first power output line connected to the first power input line by at least one branch power line in a pixel region of the display apparatus, a second power input line to which a second power supply voltage is input, a second power output line connected to the first power input line by a common electrode of the display apparatus; and a power supplier comprising:

a first voltage generator supplying the first power supply voltage to the first power input line, a second voltage generator supplying the second power supply voltage to the second power input line, a first amplifier configured to compare a first feedback voltage of the first power output line with a reference voltage and output a control voltage to the first voltage generator to adjust the first power supply voltage;

a second amplifier configured to output an inverted voltage obtained by inverting and amplifying a second feedback voltage of the second power output line; and a capacitor connected between an output of the amplifier and the second power input line.

* * * * *